United States Patent [19]

Ming

[11] Patent Number: 4,913,214

[45] Date of Patent: Apr. 3, 1990

[54] FULL AUTOMATIC AND VERTICAL TYPE LOUVER

[76] Inventor: Nien Ming, Rm. 4, 4F, wonderful Bldg., 101, Sec. 4, Jen-Ai Road, Taipei, Taiwan

[21] Appl. No.: 256,031

[22] Filed: Oct. 11, 1988

[51] Int. Cl.[4] ..... E06B 9/30

[52] U.S. Cl. ..... 160/168.1; 160/188; 160/900

[58] Field of Search ..... 160/168.1, 188, 176.1, 160/900, 178.1

[56] References Cited

U.S. PATENT DOCUMENTS 4,291,738 9/1981 Grenga et al. ..... 160/900 X 4,735,251 4/1988 Tsuchida et al. ..... 160/7 X

*Primary Examiner*—Blair M. Johnson

*Attorney, Agent, or Firm*—Asian Pacific International Patent and Trademark Office

[57] ABSTRACT

The invention relates to the control of vertical louver, which is to improve the slide-tract of regular vertical louvers, by means of motor and drag chain to control the opening and closing, and the expansion and collapsing of the blades; by means of pressing down the control button of the control panel to automatically control the louver; respective limit switches being provided for limit control on opening, closing, expanding and collapsing, so as to make the invention become more practical.

3 Claims, 7 Drawing Sheets

FULL AUTOMATIC AND VERTICAL TYPE LOUVER

BACKGROUND OF THE INVENTION

Regularly, for a structural design of a construction, one may firstly consider sufficient lighting, beautiful style, and decorative effect. Therefore, in practice, practical use and beautiful style are commonly required. For said reason, louvers have been commonly and preferably used in most construction projects. Currently, there are innumerable types of louvers available on the market. However, the louvers that are commonly used, either vertical or horizontal type, are not perfect in performance. In order to provide the most practical louvers to serve the people, the present inventor has created a fully automatic and vertical type louver, which is directly controlled by push buttons. Thus, the complicated manual operation in conventional louvers to control the opening or closing of a louver is not necessary in the present invention.

SUMMARY OF THE INVENTION

The invention relates to a fully automatic and vertical type louver, wherein a motor is arranged to control the 25 opening and closing of the blades, and another motor is arranged to control the expansion and collapsing of the louvers, so as to let the louvers, be automatically controlled; by means of push-button swistch control, no manual operation is required; by means of limit switches the 30 blades of the louver are accurately positioned.

BRIEF DESCRIPTION OF THE DRAWINGS

FIGS. 6 and 6-1 are structural drawings of the control shaft for the blade at the fixed end.

DETAILED DESCRIPTION OF THE PREFERRED EMBODIMENT

Figure 1:
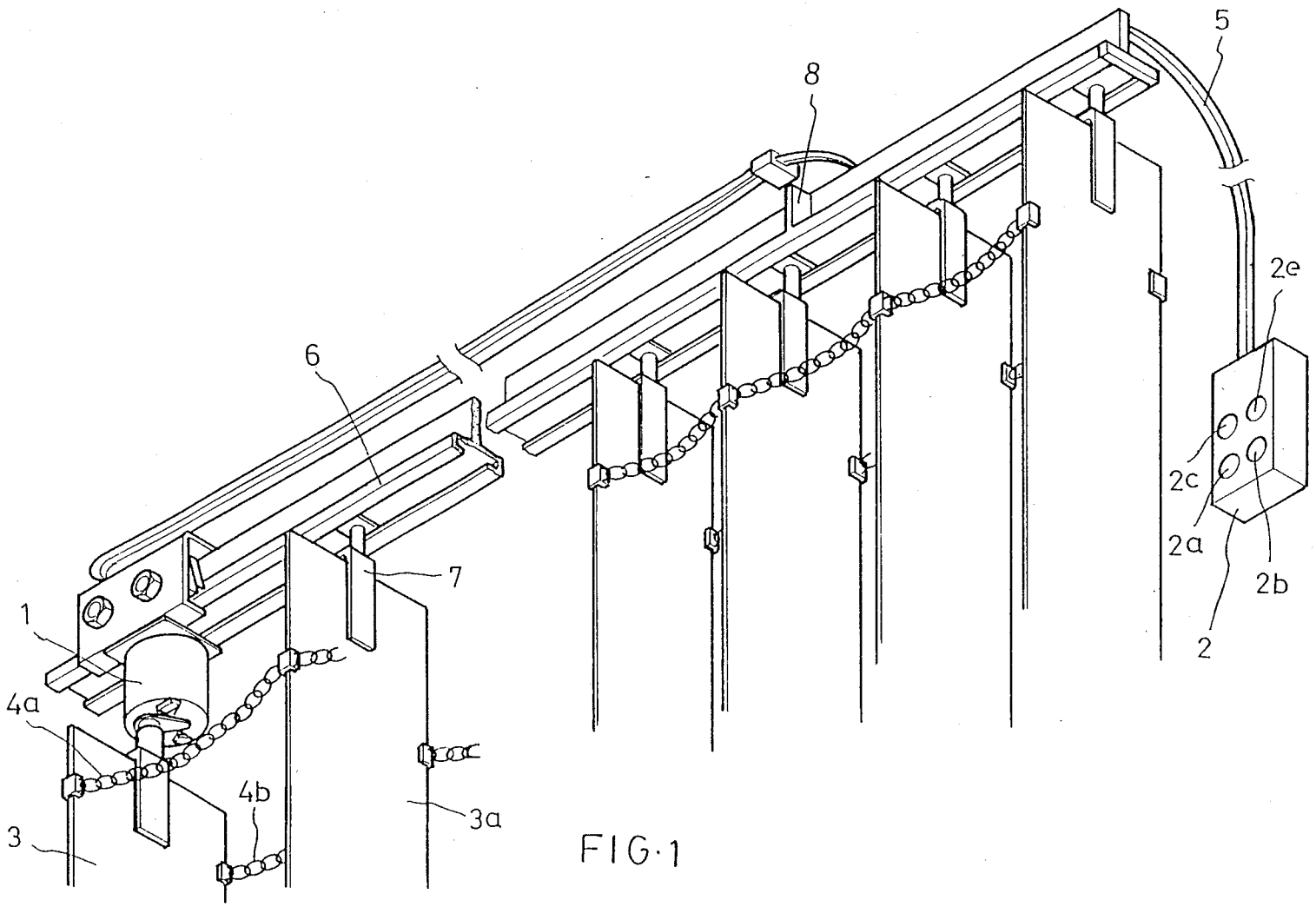
FIG. 1 is a schematic drawing, illustrating the arrangement of the invention.

Referring to FIG. 1, a control motor compartment 1 is to control the opening and closing and the right-left shifting of the louver blades. The louver blades are opened by means of the control button 2a on the control panel 2. A control motor is arranged in motor compartment 1 so that driving blade 3 is turned and simultaneously causes the drag chain 4a to rotate all driven blades to the open position. By the same measure as described above, when the button 2b is pressed down, all blades of the louver are turned to close by means of a linking-up operation through the drain chain 4b. The blades of the louver are pushed leftward by pressing down on button 2c on control panel 2; a right-left shifting control motor in motor compartment 1 is thereby operated by means of the bus 5. The motor compartment 1 and associated carriage 108 (FIG. 3) are leftware along slide-track 8 to cause all blades of the louver to move leftward so that the louver is expanded. By pressing down on button 2e on panel 2 the blade assembly will be moved rightward to a collpased condition. As shown in FIG. 1, the slide-track 6 is designed to provide shaft hangers 7 for connection of the blades.

Figure 2:
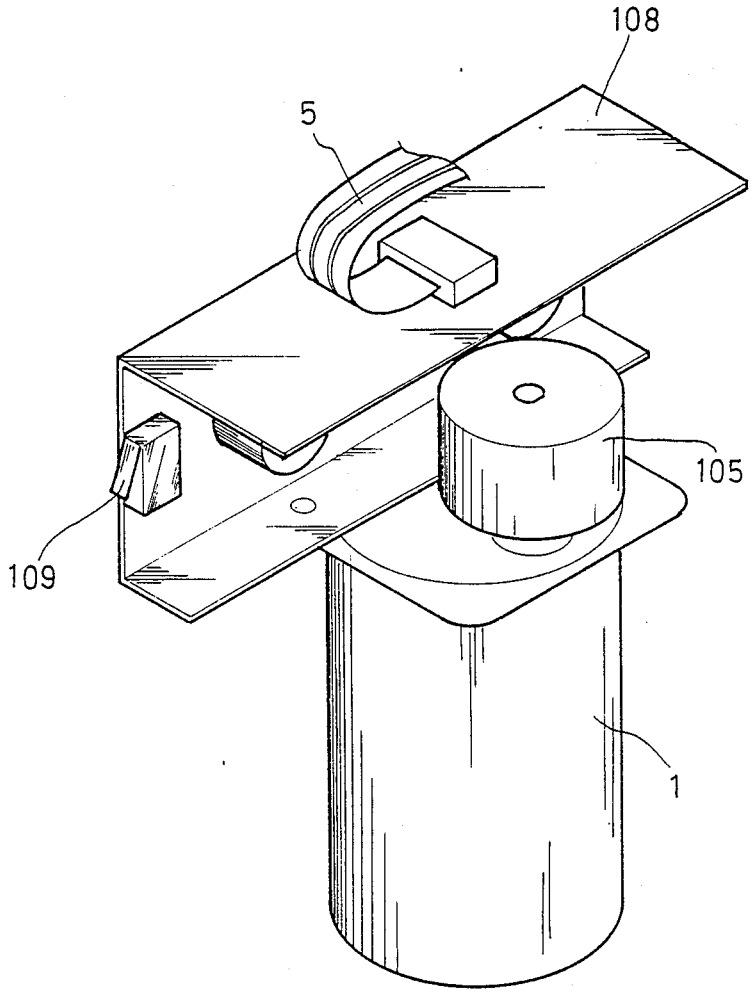
FIG. 2 is a schematic drawing, illustrating the structure of the motor compartment.
Figure 3:
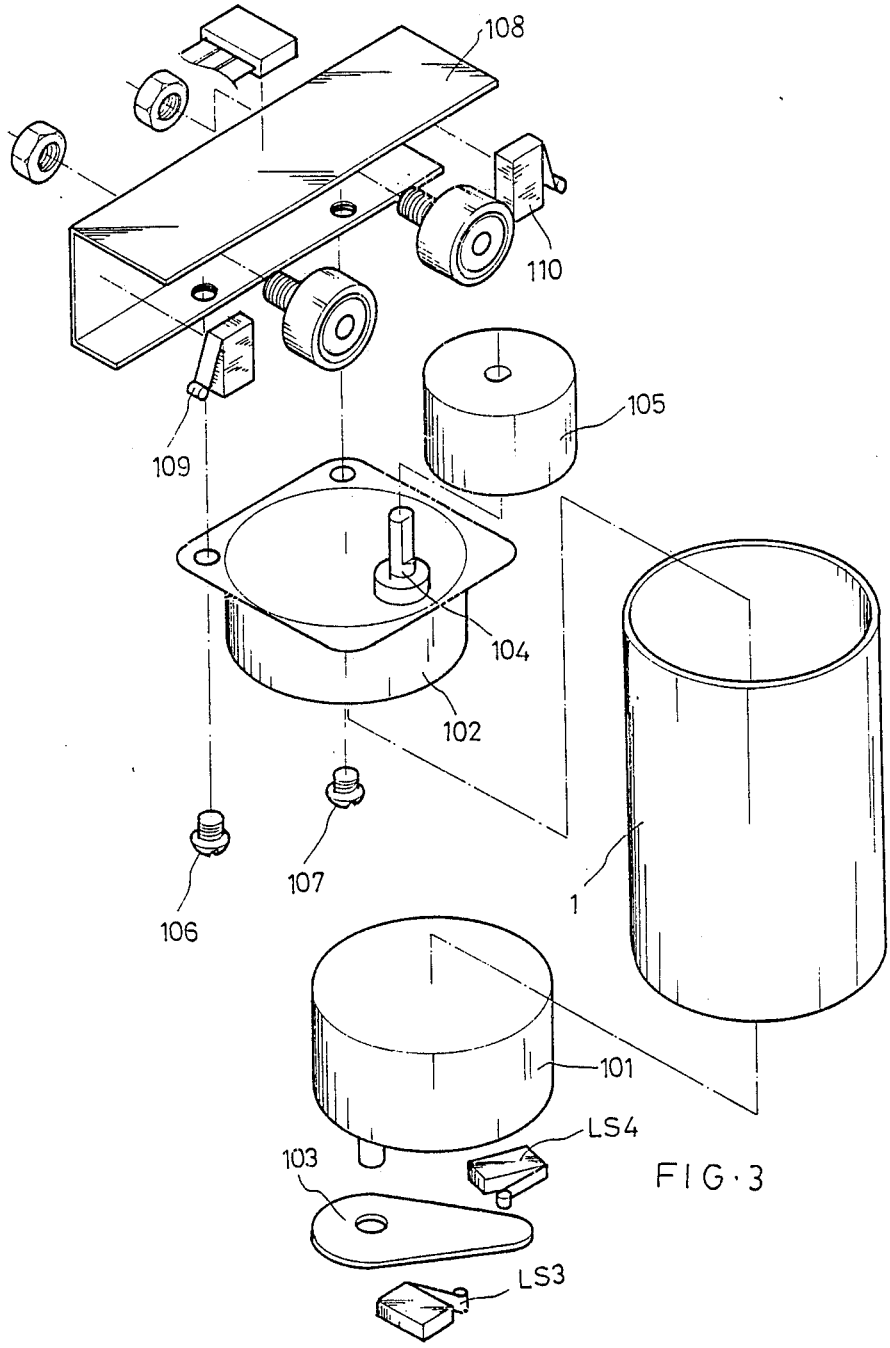
FIG. 3 is a fragmentary drawing of the motor compartment.

Referring to the schematic drawing and the fragmentary drawing of the motor compartment as shown in FIGS. 2 and 3, two independent motors are arranged inside the housing of the motor compartment 1; one is a blade revolving control motor 101, and the other is a blade expansion control motor 102. When blade revolving control motor 101 is turned on, the bottom fin or arm 103 which is attached to the shaft of the motor 101 is driven to revolve. Two limit switches LS3 LS4 are bilaterally arranged at an angle of 80° around the circumference of the motor 101 to limit the open and close position of the blades. When the blade expansion control motor 102 is turned on, the shaft 104 causes a driving wheel 105 to rotate, so that the whole assembly of the motor compartment is driven to move rightward or leftward by means of the friction of the driving wheel 105 and the slide-track 6, to thus cause the blades to expand or to collapse. The motor 102 is fixedly attached to a transverse carriage 108 by means of screws 106 107. Two limit switches 108 110 are respectively arranged at each side of the transverse carriage 108 for limit control of right-left displacement. During collapse of the blades, the motor 102 will stop revolving immediately after the limit switch 110 contacts the check plate 8 (as illustrated in FIG. 1). On the other hand, during expansion of the blades, the limit switch 109 works in the same manner.

Figure 5:
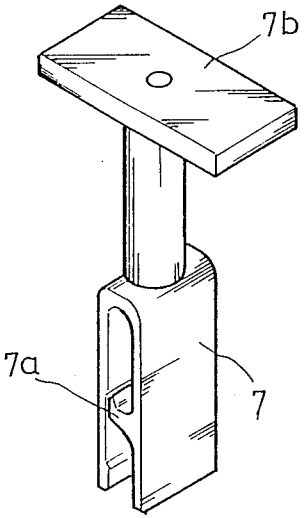
FIG. 5 is a structural drawing of the driven blade control shaft.
Figure 4:
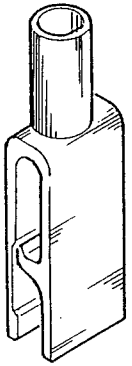
FIG. 4 is a structural drawing of the driving blade control shaft.

FIG. 4 illustrates the structure of the driving blade 3 revolving control shaft. FIG. 5 illustrates the structure of the driven blade 3a control shaft. The connecting portion of the driven blade control shaft is arranged to provide an U-shape 7 including a hook 7a to tightly hold down the blade 3a; the top end of the shaft is arranged to provide a sliding block 7b which is to be arranged in the slide-track 6 as shown in FIG. 1, for suspension of the associated blade.

Figures 1, 6:
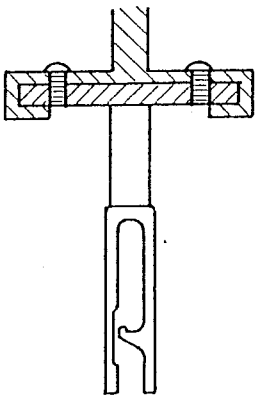
Figure 6:
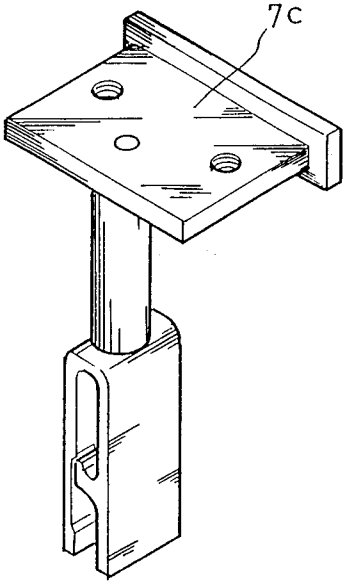

Referring to structural drawing of the control shaft for the blade at the fixed end as shown in FIG. 6, the shaft has a structure similar to other driven blade control shafts, with the only difference being the structure of top block 7c which is to be fixedly attached to the slide-track 6 to right end (FIG. 1); the longitudinal section of this control shaft is as shown in FIG. 6-1.

Figure 7:
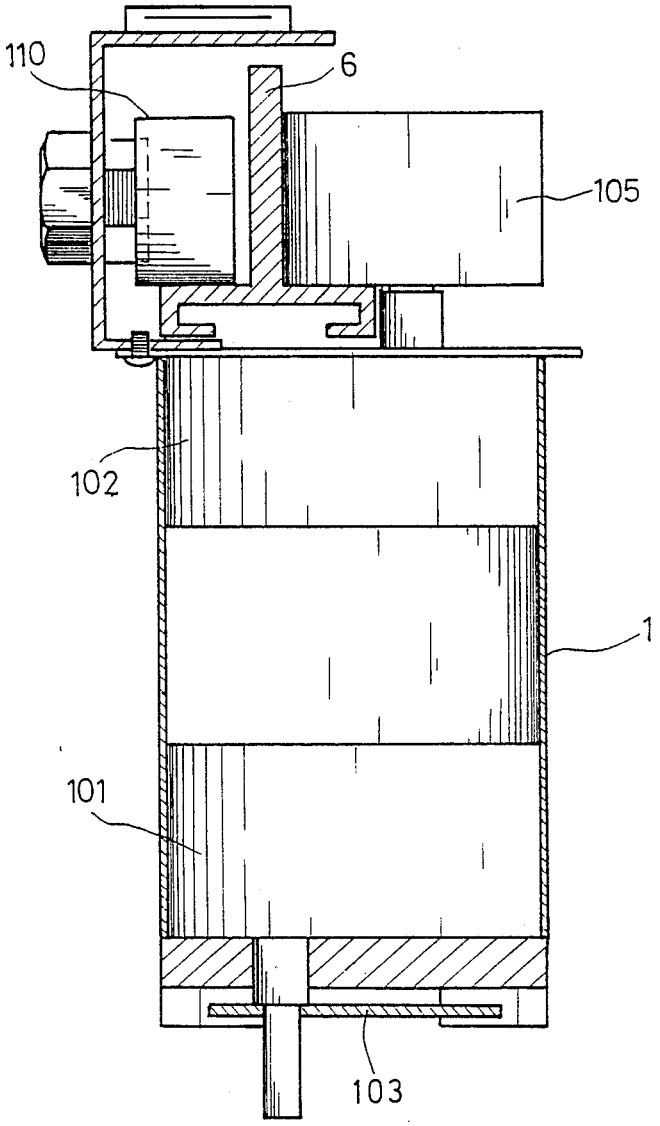
FIG. 7 is a side view drawing of the motor compartment.

Referring to the internal section of the motor compartment as shown in FIG. 7, the blade revolving control motor 101 is arranged at at the lower portion of the motor compartment 1. The blade expansion control motor 102 is arranged at the upper portion of compartment 1 and the driving wheel 105 is arranged to be closely in contact with one side of the slide-track 6 and is balanced by means of a pressure wheel 110 arranged at the opposite side of track 6.

Figure 8:
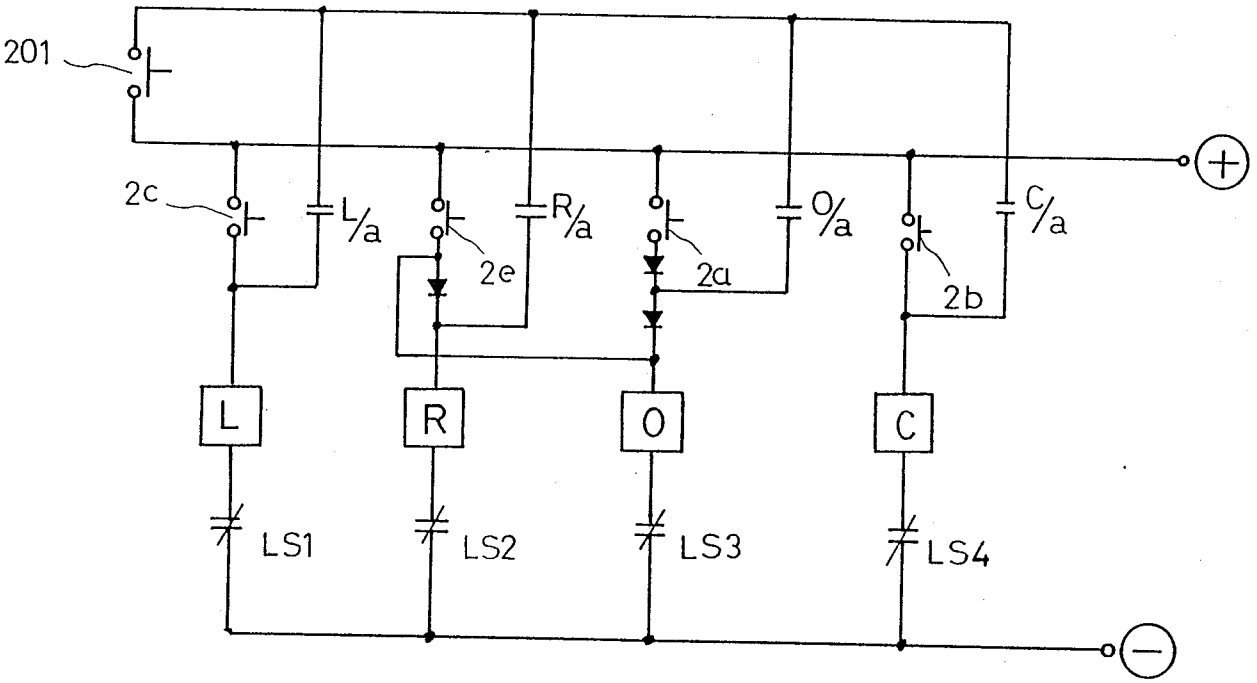
FIG. 8 is a control circuit diagram for the invention.

Please refer to the control circuit diagram of the invention as shown in FIG. 8. The relay L is controlled by push button switch 2c. The selector switch 201 is for selection of inching or automatic function. When the switch 201 is opened, it provides for inching control, such that the various buttons 2a, 2b, 2c and 2e should be continuously pressed down to control the relays; when the switch 201 is closed, the system is set in the automatic function, wherein each relay will be continuously excited by pressing and releasing the associated push button. The excited relay will be stopped by the associated limit switch. The limit switch LS1 is for left limit control, LS2 is for right limit control LS3 is for blade open llimit control, and LS4 is for blade close limit control. The button switch 2*c* is for leftward shifting control; 2*e* is for rightward shifting control, 2*a* is for blade opening contrl, and 2*b* is for blade closing control. L/a is a normal opened contact of the relay L, R/a is a normal opened contact of the relay R, O/a is a normal opened contact of the relay O, C/a is a normal opened contact of the relay C. As shown ;in the diagram, when the button switch 2*e* is pressed down, the relay R and the relay O are simultaneously excited, therefore, all the blades are opened while collapsing.

Figure 9:
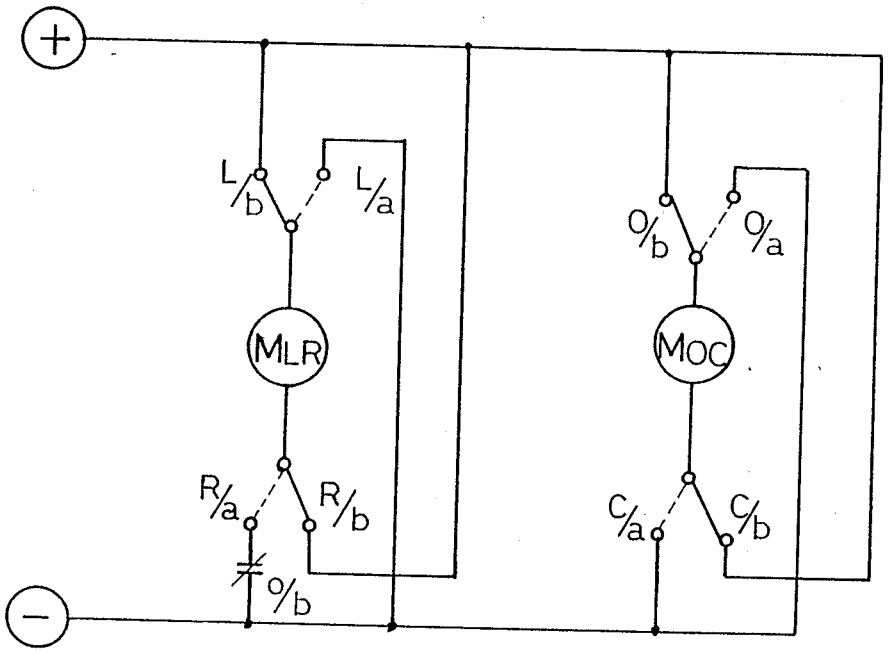
FIG. 9 is a circuit diagram for the motor compartment

Please refer to the circuit diagram for the motor compartment as shown in FIG. 9. The motor (MLR) is for right-left shifting control, (MOC) is for blade revolving control. In FIG. 7 (MLR) is motor 102, and motor (MOC) is motor 101. In FIG. 9 the control contacts L/b, L/a, R/a, R/b, O/a, O/b, C/a/, C/b are respectively controlled by the relays L, R, O, C to let the motor be applicable for clockwise or counter clockwise rotation. The control contact R/a of the motor MLR is connected with the normal closed contact of the relay O by means of series connection, such that all the blades are fully opened before the motor MLR is initiated to drive the blades for collapsing.

I claim:

1. A louver mechanism comprising: a horizontal tack (5): a series of vertically-extending louver blades located below said track; means (7*c*) for attaching a first end one of said blades to the track so that said first end blade can rotate but cannot otherwise move;

a carriage (108) movable along said track; a first reversible carriage-propulsion motor (102) mounted on said carriage for propelling said carriage back and forth along the track;

a second reversible blade-operating motor (101) mounted on said carriage; an operating connection between said second motor and a second end one of said blades, whereby said second motor is enabled to rotate said second end blade around a vertical axis between open and closed positions;

means connecting the intermediate louver blades (3*a*) to the track so that said intermediate blades can both rotate around their individual vertical axes and move bodily along the track;

flexible connectors (4*a* and 4*b*) interconnecting said blades so that when said second end blade is rotated by the second motor the other blades will be similarly rotated;

said flexible connectors being arranged so that when said carriage is moving along the track in one directions the blades will collapse against one another in near adjacency to said first end blades, and when said carriage is moving along the track in the other direction the blades will be drawn apart to attain a predetermined blade spacing;

first limit switch means for de-energizing the carriage propulsion motor when the carrage reaches the desired end limits of its motion along the track.

2. A full automatic and vertical type louver as claimed in claim 1 wherein said blade revolving control motor and said blade collapsing control motor are arranged inside a motor compartment; the blade revolving control motor being arranged at the lower position, comprising a bottom fin attached to the shaft of the motor, said bottom fin being driven to revolve within the range of 90° between said two limit switches to confine the opening and closing angle of the blades; the blade collapsing control motor being arranged at an upper position inside the motor compartment to drive a driving blade control shaft by means of the motor shaft, by means of the friction of the driving blade control shaft against said slide-tract, the whole assembly of the motor compartment and the blades being drive to move leftward or rightward.

3. A full automatic and vertical type louver as claimed in claim 1, wherein the loop of the blade collapsing control motor is excited only after the limit switch is opened at the time the blades reach full open position.

* * * * *